US006415429B1

(12) United States Patent
Grundy

(10) Patent No.: US 6,415,429 B1
(45) Date of Patent: Jul. 2, 2002

(54) FIELD PROGRAMMABLE ANALOGUE PROCESSOR

(76) Inventor: David Latham Grundy, 30 Lovers Lane, Grasscroft, Oldham OL4 4DT (GB)

( * ) Notice: Subject to any disclaimer, the term of this patent is extended or adjusted under 35 U.S.C. 154(b) by 0 days.

(21) Appl. No.: 09/254,490

(22) PCT Filed: Sep. 1, 1997

(86) PCT No.: PCT/GB97/02336

§ 371 (c)(1),
(2), (4) Date: May 6, 1999

(87) PCT Pub. No.: WO98/10362

PCT Pub. Date: Mar. 12, 1998

(30) Foreign Application Priority Data

Sep. 6, 1996 (GB) ..... 9618648

(51) Int. Cl.[7] ..... G06F 17/50
(52) U.S. Cl. ..... 716/17; 716/16; 716/1
(58) Field of Search ..... 716/17, 16, 1; 703/4; 326/39, 41

(56) References Cited

U.S. PATENT DOCUMENTS 5,541,538 A * 7/1996 Bacrania et al. ..... 317/77
5,563,526 A * 10/1996 Hastings et al. ..... 326/37
5,959,871 A * 9/1999 Pierzchala et al. ..... 703/4
6,121,823 A * 9/2000 Summerfield ..... 327/538

FOREIGN PATENT DOCUMENTS

EP 0 450 863 A2 10/1991

OTHER PUBLICATIONS

Vallancourt et al, "Timing–Controlled Fully Programmable Analog Signal Processors Using Switched Continuous–Time Filters," IEEE, Aug. 1988, pp. 947–954.*

Lu et al, "The Design of the CMOS Current–Mode General–Purpose Analog Processor," IEEE, Jun. 1994, pp. 549–552.*

Song et al, "Design of a Geometric–Mean Generator Based on Switched–Current Technique," IEEE, 1996, pp. 409–412.*

D.L. Grundy, "A Computational Approach to VLSI Analog Design", Journal of VLSI Signal Processing 8 (1994) Jul., No. 1., 8 pp.

Press Release—Dec. 5th, 1995, *Pilkington Licenses New Programmable Analogue Array Technology to Motorola*, 1 pg.

IMP50E10 Data Sheet, *EPAC product line*, "General Description", Jan. 3, 1996, 2 pgs.

IMP50E10 EPAC Data Sheet, "EPAC Feature Highlights", Jan. 3, 1996, 3 pgs.

IMP50E10 EPAC Data Sheet, "Functional Modules", Jan. 3, 1996, 3 pgs.

IMP50E20 Advance Product Data Sheet, Jan. 3, 1996, 8 pgs.

Edward K.F. Lee et al., "A Transconductor–Based Field Programmable Analog Array", Feb. 16, 1995 IEEE International Solid–State Circuits Conference, 3 pgs.

* cited by examiner

*Primary Examiner*—Vuthe Siek
(74) *Attorney, Agent, or Firm*—Skjerven Morrill MacPherson LLP; Norman R. Klivans

(57) ABSTRACT

A programmable analogue device including an array of cells. Each cell is controllable for performing a predetermined set of analogue functions. The cells are selectively interconnected for programming selected analogue circuits. Each cell includes an array of subcells, an output circuit coupled to each of the subcells for delivering an analogue output as determined by the analogue function of an activated subcell, and a function control circuit for activating a particular subcell in dependence upon a function select input. Each subcell performs one of the analogue functions among the predetermined set, and includes a differential pair of transistors defining an operational amplifier with the input bias circuit. Each subcell is activated using a series switch in the subcell which couples the subcell to an input bias circuit; the series switch in each subcell is in turn coupled to and controllable by the function control circuit.

10 Claims, 6 Drawing Sheets

FIELD PROGRAMMABLE ANALOGUE PROCESSOR

BACKGROUND

1. Field of the Invention

This invention relates to a field-programmable analogue processor.

2. Related Art

There are many situations in which analogue signal, processing can offer significant advantages over digital signal processing. For example, digital processing of signals conventionally requires the steps of sampling signal, analogue-to-digital conversion, digital processing, and digital-to-analogue conversion. In contrast, analogue signal processing allows a signal to be processed directly, thus providing a considerable saving both in the number of components required to perform a processing operation and a reduction in the time required for the operation.

Analogue signal processing is currently under-utilised. One reason for the relatively low usage of analogue processing is that the design of analogue circuits, which commonly is at component level, is a complex process requiring a considerble investment of time in both design and testing of a circuit. Analogue design is very specialised, requiring a detailed knowledge of the response of individual components, and consequently is expensive. Thus, when faced with a signal processing task, a designer may be willing to sacrifice the speed and simplicity of a custom built analogue circuit in favour of a less efficient but more easily realised digital circuit An analogue processor which could be configured via a computer interface to perform required tasks would clearly be all extremely useful and beneficial development. Such a processor would allow a relatively inexperienced person to produce a required analogue circuit. Furthermore, the processor could be configured to perform a given task very rapidly, a considerable advantage over the current standard development process which comprises circuit design, manufacture, prototype testing and redesign.

One known design of analogue signal processor uses switched capacitor circuits based on digital technology. Conventional operational amplifiers within the processor are provided with feedback loops containing switchable capacitors which are switched on or off to select required mathematical functions. While this approach provides an adequate programmable analogue processor, it is rather bulky and contains a large number of components which occupy a large area.

The concept of a different computational approach to VLSI analogue design was described by D. Grundy in a paper published in 1994 (Journal of VLSI Signal Processing 53, 8 (1994)). The paper describes how a programmable analogue processor could be realised by reducing a required process to a series of fundamental mathematical steps, these steps being ADD, NEGATE, LOG, ANTILOG, AMPLIFY, (EXPONENTIAL) and DIFFERENTIATE. The paper suggests that any process capable of being broken down into a series of mathematical steps could be programmed into an analogue processor by providing the processor with cells each of which can be programmed to perform any one of the steps, selecting the steps to be performed by individual cells, and connecting them in the required order.

SUMMARY

The configuration of programmable analogue circuit suggested in the paper comprises two strings of cells connected in series, each string receiving an input signal. Each cell is programmed to perform a mathematical function chosen from the above list, and the output from one cell becomes the input to a following cell in a series of cells. The two strings may be linked together to perform functions (for example division) which require two inputs and a combination of cells. An experimental circuit which has been used to generate a logarithmic function is illustrated in FIG. 7 of the paper. The circuit uses silicon junctions to provide logarithmic functions and resistors to convert voltages into current. The circuit has the advantage over switched capacitor circuits of more functions, wider dynamic range, real time operation and speed for a given device size. A disadvantage of this design of circuit is the requirement for external components to set gain and RC time constraints. The advantages outweigh the disadvantages however in many applications, and the present invention is related to a practical device for implementing a system of the same general type as that described in the above paper.

It is an object the present invention to provide an improved field programmable analogue processor.

According to the present invention, there is provided a programmable analogue device comprising an array of cells each of which is controllable to perform any one of a predetermined set of analogue functions, and means for selectively interconnecting the cells to define an analogue circuit between a device input and a device output, wherein each cell comprises an array of subcells each of which is designed to perform a respective one of the predetermined set of analogue functions, each cell comprises an input bias circuit, each subcell comprises a series switch which may be selectively switched to a conductive state so as to connect the subcell to the input bias circuit, each cell comprises a function control circuit which selectively switches on one of the series switches in dependence upon a function select input, each subcell comprises a differential pair of transistors which when electrically coupled by the respective series switch to the bias circuit define an operational amplifier with the input bias circuit, and each cell comprises an output circuit connected to each of the subcells such that the output circuit delivers an analogue output dependent upon the function of the operational amplifier defined by the input bias circuit and the differential transistor pair to which the input bias circuit is connected by the conductive series switch.

Preferably, further switches are provided each of which forms part of a respective subcell and is controlled by the function control circuit to be rendered non-conductive only when the series switch of the respective subcell is conductive, the further switches being arranged when conductive to minimize the effect of the associated subcell on the operation of the device.

The further switches may be connected to shunt resistive components of the associated subcells.

The differential pain of transistors of at least one subcell may be connected to an associated resistive component by an isolating switch which is connected in series between the resistive component and the differential pair of transistors, the isolating switch being rendered conductive only when the series switch of the subcell is rendered conductive. In circuits in which the differential pair of transistors is coupled to source and feedback resistors, respective isolating switches may be connected in series with those resistors. A shunt switch may be connected between the two isolating switches.

BRIEF DESCRIPTION OF THE DRAWINGS

Embodiments of the present invention will now be described, by way of example, with reference to the accompanying drawings, from which, for ease of explanation, voltage sealing has been omitted and in which.

DETAILED DESCRIPTION

Figure 1:
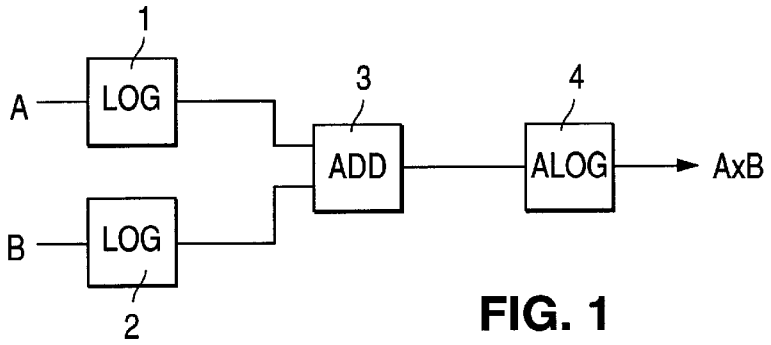
FIG. 1 is a schematic representation of a multiplication operation which may be performed using standard circuits in an embodiment of the present invention.

Referring to FIG. 1, the mathematical operation of multiplication of two operands A and B is represented. Each of the operands is input to a respective cell 1 and 2 which converts the analogue value appearing at its input to an analogue output representing the logarithm of that value. A cell 3 then adds the two logarithms and a cell 4 converts the resultant logarithm to an analogue value representing the product of the analogue values represented by the operands A and B.

Figure 2:
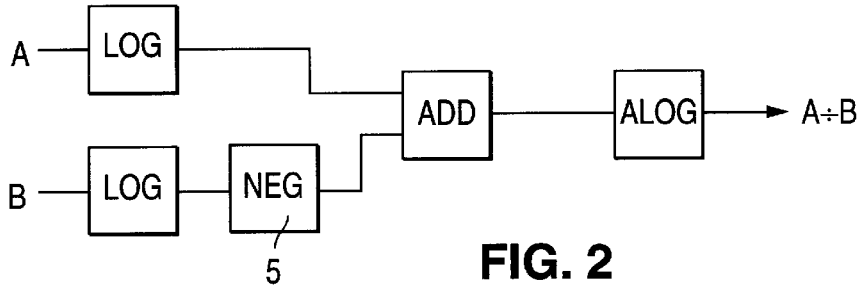
FIGS. 2 and 3 are schematic representations of different mathematical operations which may be performed using standard circuits in accordance with the present invention.

FIG. 2 represents the mathematical operation of division, the cell 5 negating the analogue value at its input.

Figure 3:
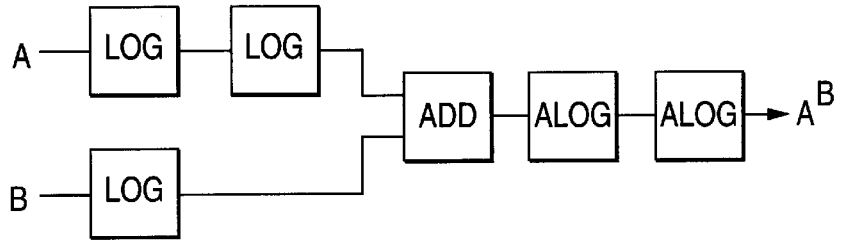

FIG. 3 represents the operation of raising the operand A to the power B. It will be appreciated from FIGS. 1, 2 and 3 that many simple and more complex mathematical operations can be performed by an appropriate network of functional cells each of which is in itself a relatively simple circuit.

Figure 4:
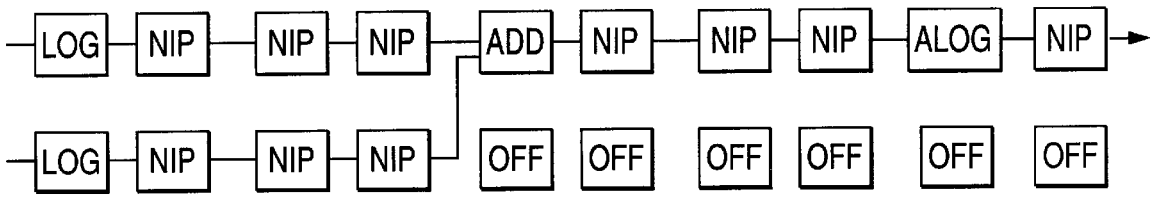
FIG. 4 is a schematic representation of a cell structure in a programmable analogue device in accordance with the present invention set up to perform the mathematical operation represented by FIG. 1.

FIG. 4 represents a device in accordance with the present invention incorporating twenty cells arranged in two rows of ten cells each. Adjacent cells in each row are directly interconnected and the output of any one cell in each row may be connected to a second input of a respective cell in the other row by appropriate switching devices (not shown). Each cell may be switched to any one of eight conditions, that is non-inverting pass (NIP) in which the cell operates as a unity gain buffer stage, add in which the cell operates to add signals applied to two inputs, negate in which the cell changes the sign of the input signal, log in which the cell produces an output representing the logarithm of the input, alog in which the cell produces an output representing the anti-logarithm of its input, rectify (RECT) in which the cell produces an output corresponding to the rectification of the input and auxiliary (AUX) which facilitates the connection of external components to perform extra functions such as integrate, differentiate or the like. Each cell can also be switched to an off condition in which the cell is dormant. The cells shown in FIG. 4 have been switched to a configuration in which they perform the function represented by FIG. 1. It will be noted that in this simple configuration many of the cells are acting merely as buffers or are dormant. The cells could be configured, however to perform complex analogue functions.

Figure 5:
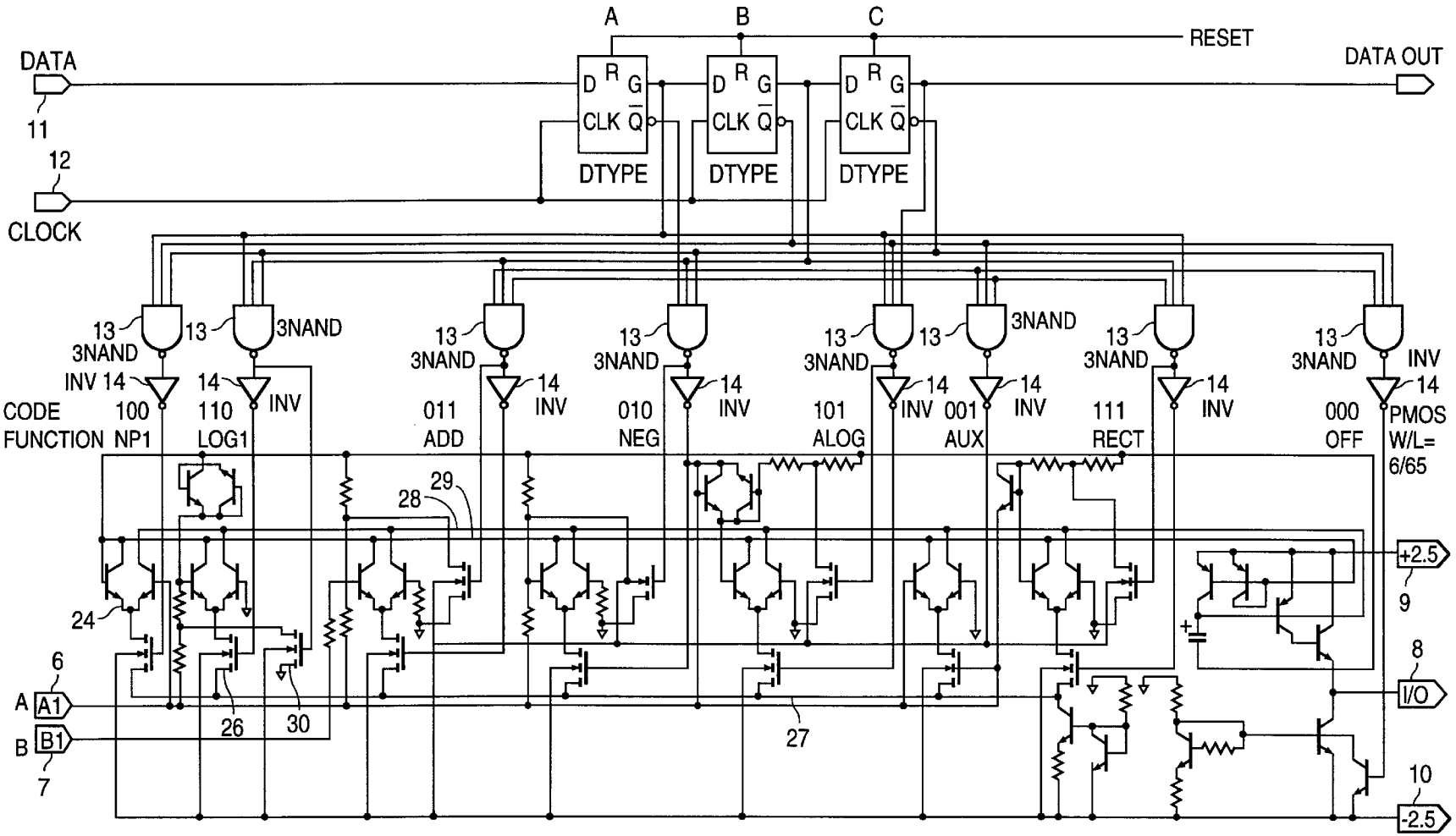
FIG. 5 is a circuit digram representing one of the twenty cells shown in FIG. 4.
Figure 8:
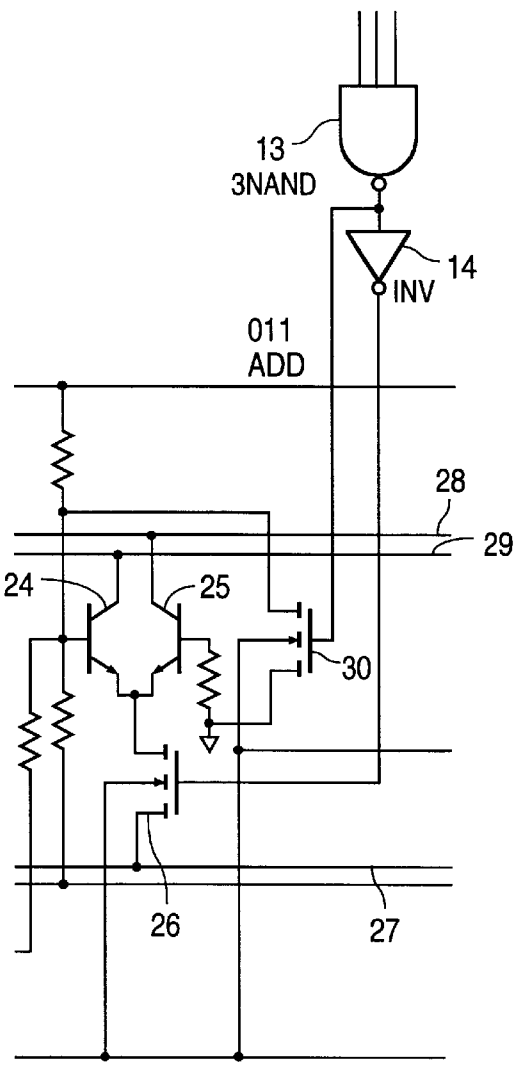
FIGS. 6, 7, 8, 9, 10, 11, 12 and 13 show respective subcells incorporated in the circuit illustrated in FIG. 5.
Figure 7:
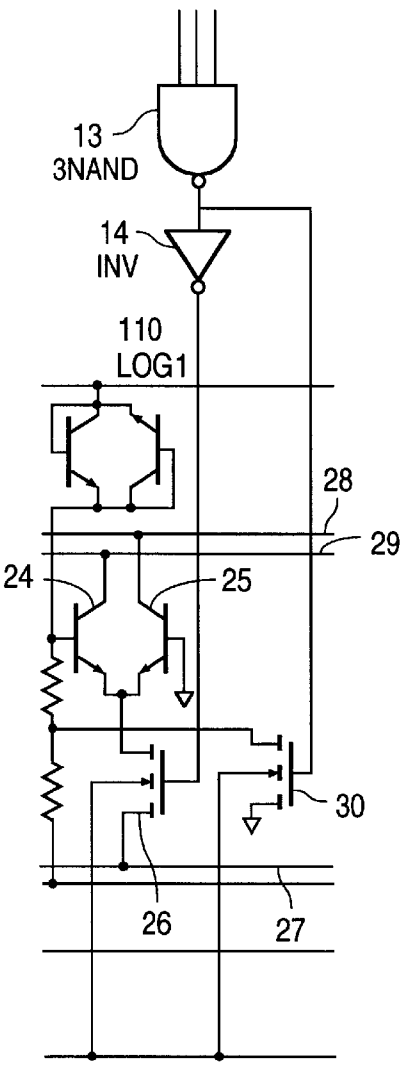
Figure 6:
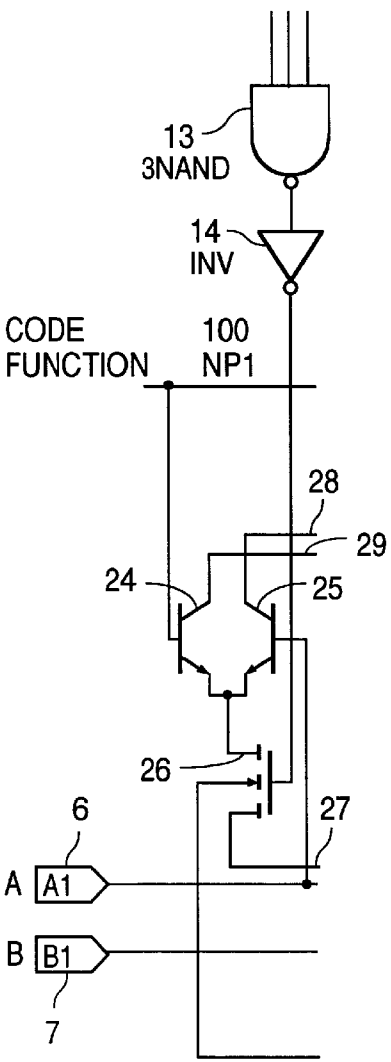
Figure 11:
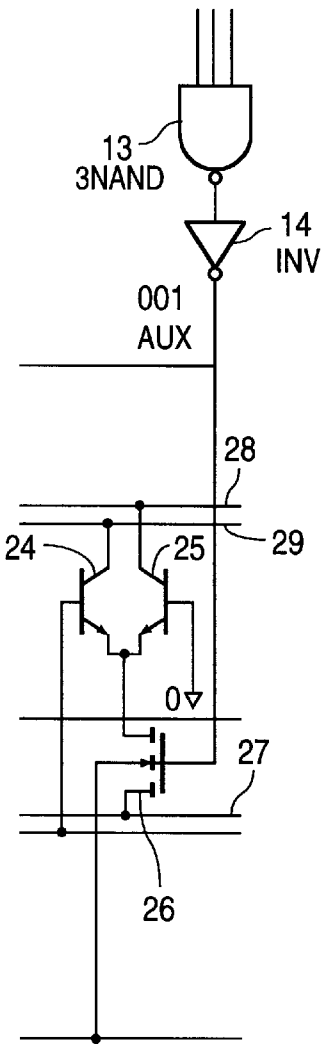
Figure 10:
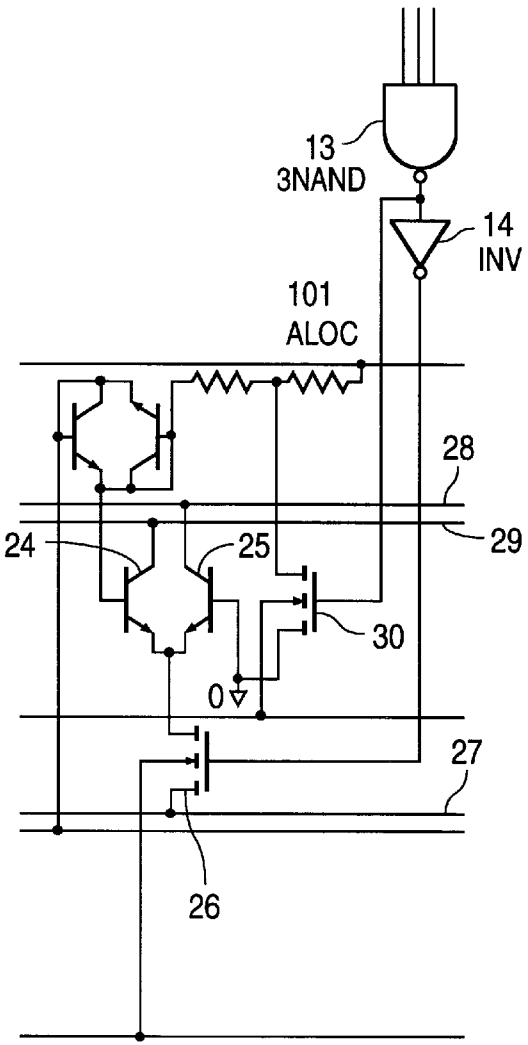
Figure 9:
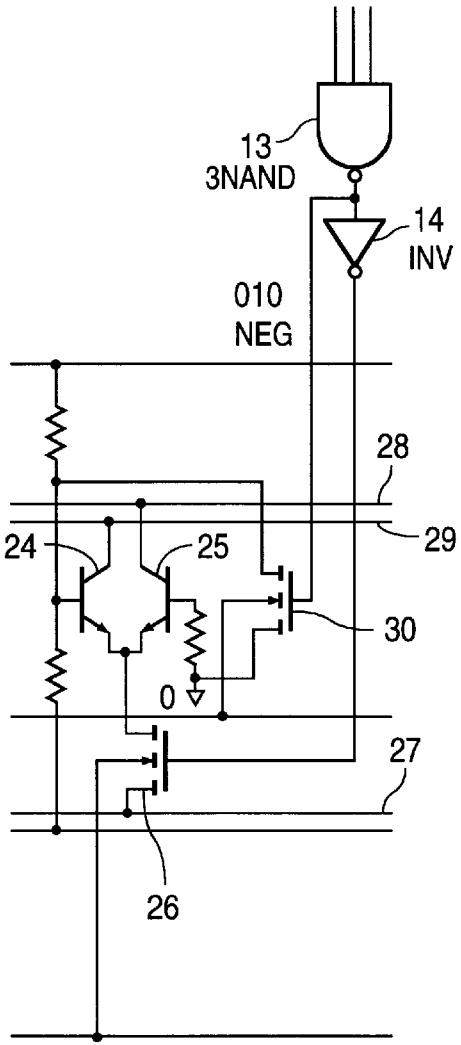

FIG. 5 is a circuit diagram illustrating the circuit of one of the twenty cells shown in FIG. 4. Input signals representing operands are applied to input terminals 6 and 7. When the cell is to operate in addition mode the two signals to be added would be applied to inputs 6 and 7. In all other modes the input signals to be operated upon would be applied to input 6. The cell output appears at output terminal 8. The cell is powered from terminals 9 and 10 which carry respectively plus 2.5 volts and minus 2.5 volts. The cell is controlled by a digital data input applied to terminal 11 and a clock signal applied to terminal 12.

The cell of FIG. 5 comprises seven subcells and an output circuit, these eight circuits being represented, respectively, in FIGS. 6 to 13. Each of these circuits is controlled by the output of a respective nand gate 13 and associated inverter 14, the nand gates 13 being switched such that the output of each of them is high only when the three-bit output of an array of three flip-flops corresponds to a respective one of the eight possible values for such a three-bit output. The binary values are represented in FIG. 5 by 100, 110, 011, etc. Thus each of the subcells can be controlled by the application of appropriate digital control signals to terminal 11.

Figure 12:
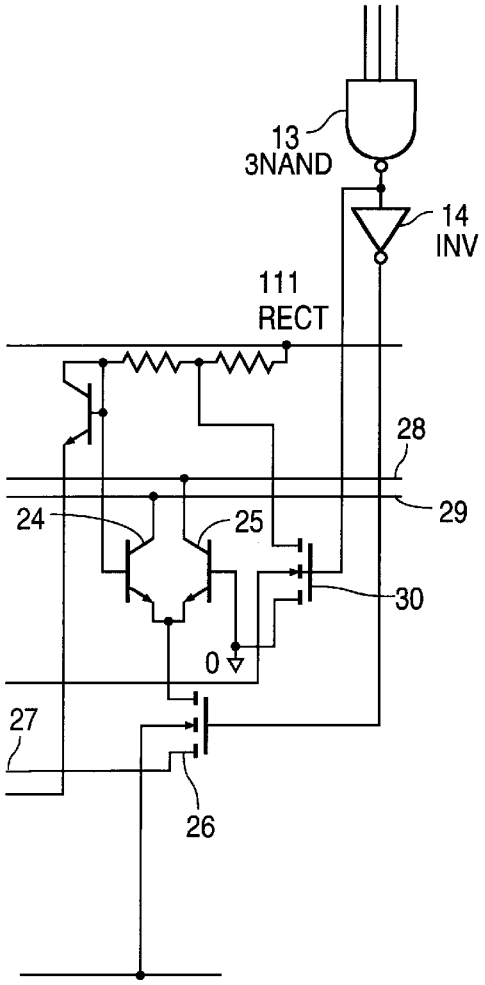
Figure 13:
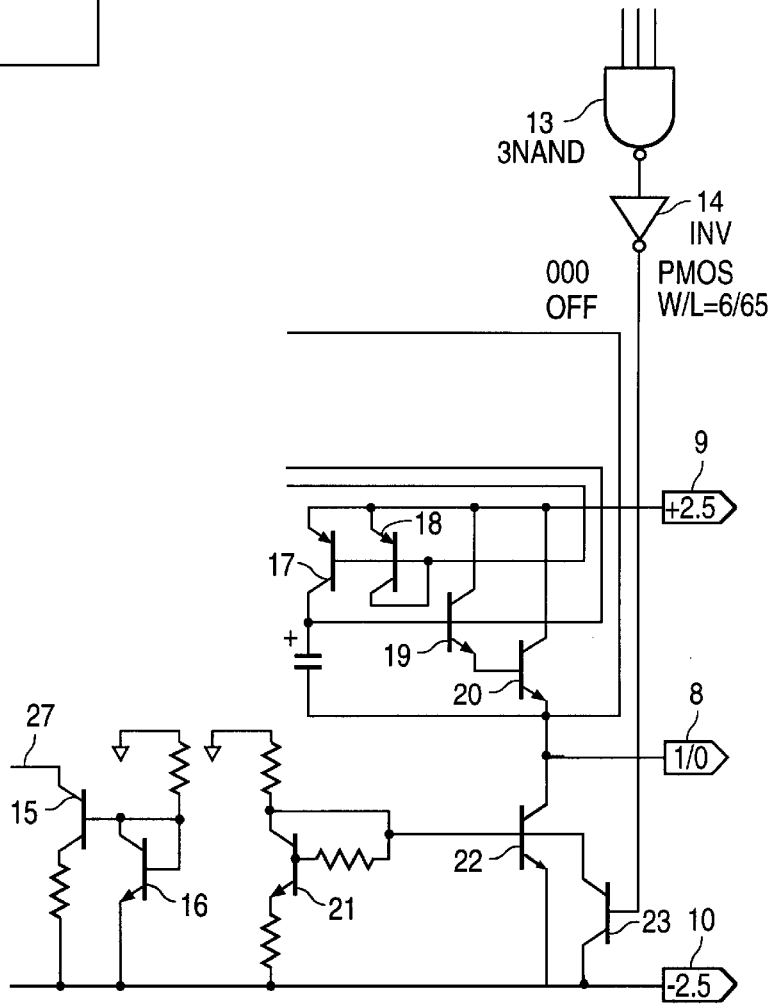

The output circuit of FIG. 13 comprises an input bias circuit defined primarily by transistors 15 and 16, and an output stage defined primarily by transistors 17 to 23. Each of the subcells of FIGS. 6 to 12 comprises a differential pair of transistors 24, 25 connected by series transistor switches 26 to a line 27 coupled to the collector of the transistor 15. Each of the transistor pairs 24 and 25 is also connected by lines 28, 29 to transistors 17, 18 and 19.

The switches 26 are controlled by the outputs of respective inverters 14. Thus the switches 26 are normally off with the exception of the one switch associated with the nand gate 13 selected by the output of the digital control circuit.

When a switch 26 is rendered conductive current flows from the input bias circuit 15, 16 and this in effect completes the circuit of an operational amplifier incorporating the respective pair of transistors 24, 25. The output appearing at terminal 8 is thus a function of the signals applied to input terminals 6 and 7, the function being defined by the circuit associated with the active subcell as selected by the conductive series switch 26. The circuits represented in FIGS. 6 to 12 respectively perform the functions of non-inverting pass, log, add, negate, anti-log, auxiliary and rectify.

Depending on the detailed structure of the circuit components associated with the transistor pairs of each cell, the provision of the series switch 26 may be sufficient when that switch is rendered non-conductive to prevent the existence of the circuit associated with that switch from significantly affecting the performance of the circuit as a whole. Where a subcell incorporates resistive components, however, it is desirable to provide auxiliary switches to minimize the shunt effect of those resistors. For example, the log function subcell (FIG. 7) incorporates a shunt switch 30 controlled by the output of the respective nand gate 13. Shunt switches 30 are also provided in the add function subcell (FIG. 8), the negate subcell (FIG. 9), the alog subcell (FIG. 10) and the rectify subcell (FIG. 12).

In the cell structure represented in FIG. 4, it is desirable to minimize resistive path losses between adjacent cells. This is particularly important to maintaining the accuracy of operation of log and anti-log functions. In general, for every millivolt of attenuation existing between log and anti-log functions, there is an approximately 4% gain error, regardless of the input signal level to the log stage. Therefore, whereas in general electronic applications several millivolts of attenuation between successive circuit stages may be tolerable, this is not so in circuits as described with reference to FIGS. 4 and 5.

Figure 14:
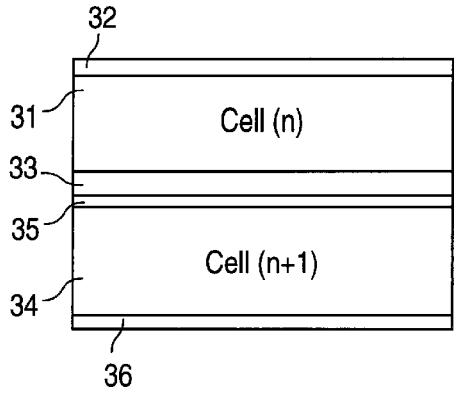
FIG. 14 is a schematic representation of a three-dimensional structure defined by stacking the subcells of FIGS. 6 to 13 and interconnecting the cells in a way which minimizes impedances between cells.

In order to minimize resistive losses between adjacent cells, it is desirable to fabricate the circuit represented by FIGS. 4 and 5 by stacking cells (one of which is shown in FIG. 5) one above the other as represented in FIG. 14. Referring to that Figure, the nth cell 31 has an input terminal 32 extending across its full width and an output terminal 33, also extending across its full width. The nth cell is stacked immediately above the (n+1)the cell 34 which has input terminal 35 and output terminal 36. The conductive tracks 33 and 35 are connected together, minimizing cell to cell attenuation given the large width of the tracks and the short length of the tracks. With such a structure the overall resistive path can be limited to the order of milliohms. As a result, attenuation losses are negligible.

In the circuit described above, cell function selection is achieved using the series switches 26 to control current into the associated differential pairs 24, 25 and the shunt switches 30 to shunt resistive components associated with the differential pairs. To select a particular function, the subcell responsible for that function is enabled by rendering the shunt switch 30 non-conductive to thereby release its associated resistor and rendering the series switch 26 conductive. This arrangement works well in terms of isolating the unused subcells, but there is a disadvantage in that current shunted to ground through the shunt switches 30 of the subcells which are not in use represents an unwanted use of power. This disadvantage can be overcome by introducing an isolation switch in series with the subcell resistors. The introduction of such an additional switch might be expected to produce an error in the subcell function due to the resistance of that switch but this can be compensated, for example, by providing two additional switches, one in series with the source resistance of the subcell and one in series with the feedback resistor of the subcell. Such an alternative circuit is illustrated in FIG. 15.

Figure 15:
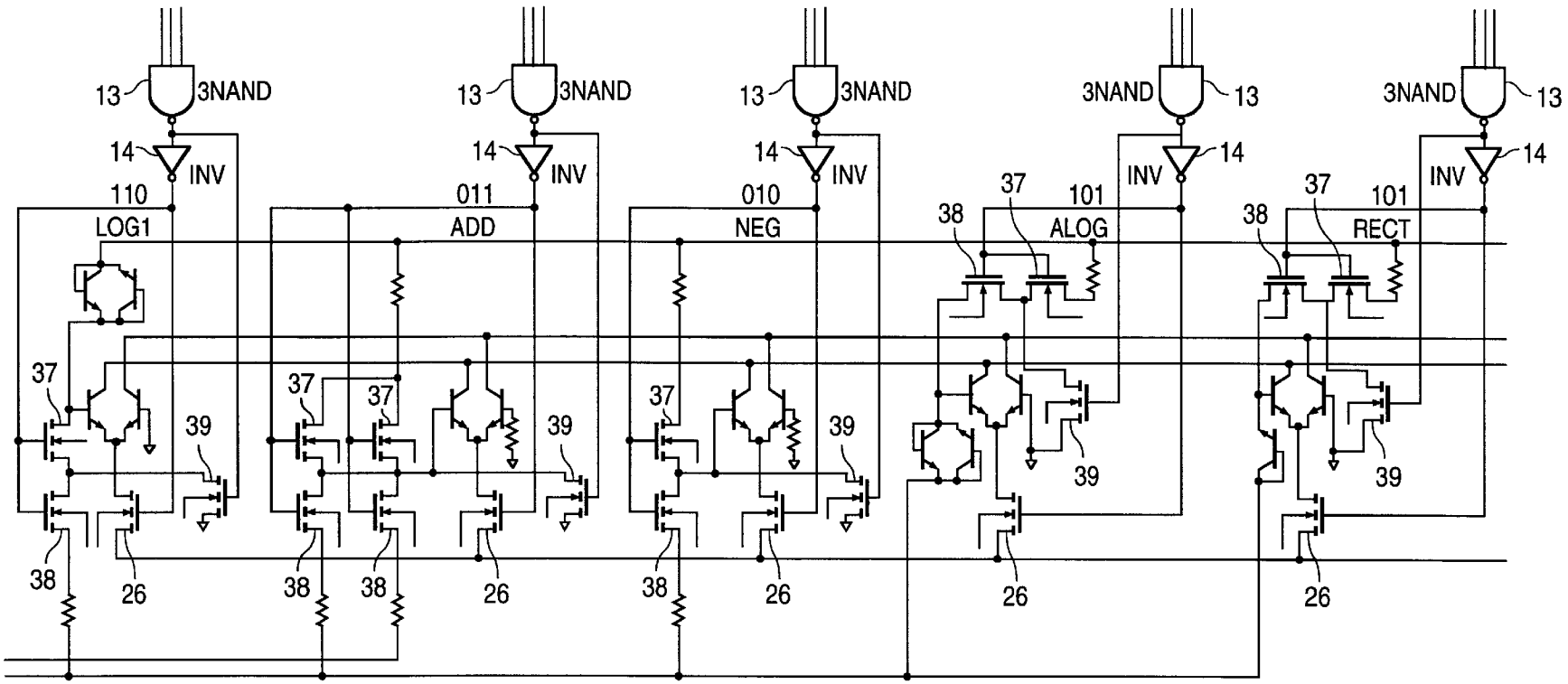
FIG. 15 is a diagram of a circuit which is an alternative to that shown in FIG. 5.

Referring to FIG. 15, the illustrated circuit components define log, add, negate, alog and rectify subcells. Each of these subcells incorporates a differential pair of transistors 24, 25 and a series transistor 26. Additional isolating switches 37 and 38 are provided, the isolating switches being rendered conductive only when the series switch 26 of the associated subcell is rendered conductive.

For the logarithmic functions, the resistances of the isolating switches 37, 38 are not directly compensated given the illustrated circuit, but these resistances cancel when the log and alog functions are combined.

In some circumstances the isolating switches 38, 39 can cause problems due to capacitive feed through. This is avoided in the circuit of FIG. 15 by the provision of shunt switches 39 which are connected between the two isolating switches.

The described circuits exhibit a number of key features and benefits as compared with existing devices. These can be summarised as follows:

(a) An analogue chip can be developed very quickly. Software has been developed which can simulate single page designs with high resolution in less than 20 seconds on a simple PC. This is means that if necessary dozens of iterations can be run without significant delay. The design enables the software to operate on the basis of a one to one correspondence between the software simulator and the chip itself. Downloading of designs from the PC running the software to the chip requires only sixty bits of information.

Viewing of chip activity may be simple, straightforward and therefore fast since every input/output its brought to a terminal pin.

(b) The device has been fabricated using BICMOS silicon technology which allows the analogue content to be designed with no compromise using bipolar components. The use of CMOS for the digital components ensures that there are similarly no compromises there. To the user this means that the amplifiers have very low offset and its associated drift, low noise, excellent high frequency performance with bandwidths of 4 MHz, and the ability to implement a wealth of proven analogue design techniques accumulated over many years.

(c) The device can be used in many applications, unlike competing devices which are limited to selected sectors such as controllers or data acquisition. The device can be likened to its digital counterpart the microprocessor in that it can be applied to any analogue situation. To the user this means that once an investment has been made in understanding and learning to use the device, this investment does not have to be repeated when changing applications.

(d) The inbuilt structural features which the device brings to the design process means that designs are more predictable and perform better. This structure also means that the design process can be opened up to a wider design community including digital designers.

What is claimed is:

1. A programmable analogue device, comprising:

an array of cells each of which is controllable to perform any one of a predetermined set of analogue functions, and means for selectively interconnecting the cells to define an analogue circuit between a device input and a device output, wherein each cell comprises an array of subcells each of which is designed to perform a respective one of the predetermined set of analogue functions, each cell comprises an input bias circuit, each subcell comprises a series switch which selectively switchable to a conductive state so as to connect the subcell to the input bias circuit, each cell comprises a function control circuit which selectively switches on at least one series switches in dependence upon a function select input, each subcell comprises a differential pair of transistors which when electrically coupled by the series switch in the subcell to the input bias circuit define an operational amplifier with the input bias circuit, and each cell comprises an output circuit connected to each of the subcells such that the output circuit delivers an analogue output dependent upon the function of the operational amplifier defined by the input bias circuit and the differential transistor pair to which the input bias circuit is connected by the series switch; and further switches each of which forms part of a respective subcell and is controlled by the function control circuit to be rendered non-conductive only when the series switch of the respective subcell is conductive, the further switches being arranged when conductive to minimize the effect of the respective subcell on operation of the programmable analogue device.

2. A programmable analogue device according to claim 1, wherein the further switches are connected to shunt resistive components of the respective subcells.

3. A programmable analogue device, comprising:

an array of cells each of which is controllable to perform any one of a predetermined set of analogue functions, and means for selectively interconnecting the cells to define an analogue circuit between a device input and a device output, wherein each cell comprises an array of subcells each of which is designed to perform a respective one of the predetermined set of analogue functions, each cell comprises an input bias circuit, each subcell comprises a series switch which selectively switchable to a conductive state so as to connect the subcell to the input bias circuit, each cell comprises a function control circuit which selectively switches on at least one series switch in dependence upon a function select input, each subcell comprises a differential pair of transistors which when electrically coupled by the series switch in the subcell to the input bias circuit define an operational amplifier with the input bias circuit, and each cell comprises an output circuit connected to each of the subcells such that the output circuit delivers an analogue output dependent upon the function of the operational amplifier defined by the input bias circuit and the differential transistor pair to which the input bias circuit is connected by the series switch; and wherein the differential pair of transistors of at least one subcell is associated with at least one resistive component and an isolating switch is connected in series between the resistive component and the differential pair of transistors, the isolating switch being rendered conductive only when the series switch of the subcell is rendered conductive.

4. A programmable analogue device according to claim 3, wherein the differential pair of transistors is coupled to source and feedback resistors via respective isolating switches.

5. A programmable analogue device according to claim 4, wherein a shunt switch is connected between the two isolating switches.

6. A programmable analogue device, comprising:

an array of cells, each cell controllable for performing any one of a predetermined set of analogue functions, each cell comprising:

a function control circuit for controlling which of the analogue functions from among the predetermined set of analogue functions is to be performed by the cell in dependence upon a function select input;

an array of subcells, each subcell designed to perform one of the predetermined analogue functions, each subcell comprising:

a differential pair of transistors defining an operational amplifier when electrically coupled to an input bias circuit;

a series switch coupling the analogue circuit to the input bias circuit, and further coupled to and controllable by the function control circuit, the function control circuit determining the analogue function of the cell by electrically coupling the subcell which performs the respective analogue function to the input bias circuit via the series switch; and at least one switch forming part of the analogue circuit and controlled by the function control circuit switch to be rendered non-conductive only when the series switch of the respective subcell is conductive, the switch being arranged when conductive to minimize the effect of the subcell on operation of the programmable analogue device;

an output circuit for delivering an analogue output dependent upon the analogue function of the subcell electrically coupled to the input bias circuit in dependence upon the function select input; and means for selectively interconnecting the cells for defining an analogue circuit.

7. A programmable analogue device according to claim 6, wherein the shunt switch is coupled to a shunt resistive component.

8. A programmable analogue device, comprising:

an array of cells, each cell controllable for performing any one of a predetermined set of analogue functions, each cell comprising:

a function control circuit for controlling which of the analogue functions among the predetermined set of analogue functions is to be performed by the cell based on a function select input;

an array of subcells, each subcell designed to perform one of the predetermined analogue functions, each subcell comprising:

a differential pair of transistors defining an operational amplifier when electrically coupled to an input bias circuit;

a series switch coupling the analogue circuit to the input bias circuit, and further coupled to and controllable by the function control circuit, the function control circuit determining the analogue function of the cell by electrically coupling the subcell which performs the respective analogue function to the input bias circuit via the series switch; and an isolating switch coupled in series between a resistive component and the differential pair of transistors, and further coupled to and controllable by the function control circuit, wherein the function control circuit renders the isolating switch conductive only when the series switch of the subcell is rendered conductive;

an output circuit for delivering an analogue output dependent upon the analogue function of the subcell electrically coupled to the input bias circuit in dependence upon the function select input; and means for selectively interconnecting the cells for defining an analogue circuit.

9. A programmable analogue device according to claim 8, wherein the differential pair of transistors is coupled to a source resistor via a first isolating switch, and a feedback resistor via a second isolating switch.

10. A programmable analogue device according to claim 9, wherein at least one shunt switch is connected between at least two isolating switches.

* * * * *